US005289648A

United States Patent [19]

Theurer et al.

[11] Patent Number: 5,289,648

[45] Date of Patent: * Mar. 1, 1994

[54] MACHINE ARRANGEMENT FOR RECEIVING, STORING AND DISTRIBUTING TRACK BALLAST

[75] Inventors: Josef Theurer, Vienna; Herbert Wörgötter, Gallneukirchen, both of Austria

[73] Assignee: Franz Plasser Bahnbaumaschinen-Industriegesellschaft M.B.H., Vienna, Austria

[ * ] Notice: . The portion of the term of this patent subsequent to Oct. 1, 2008 has been disclaimed.

[21] Appl. No.: 925,495

[22] Filed: Aug. 5, 1992

[30] Foreign Application Priority Data

Sep. 3, 1991 [AT] Austria ..... 1737/91

[51] Int. Cl.[5] ..... E02F 5/22

[52] U.S. Cl. ..... 37/104; 171/16; 104/2

[58] Field of Search ..... 37/104, 105, 106, 107; 171/16; 104/2

[56] References Cited

U.S. PATENT DOCUMENTS

| | | | |
|---|---|---|---|
| 4,576,538 | 3/1986 | Theurer et al. | 414/339 |
| 4,858,696 | 8/1989 | Theurer et al. | 37/104 X |
| 4,892,151 | 1/1990 | Theurer et al. | 171/16 |
| 5,052,132 | 10/1991 | Theurer et al. | 37/104 |
| 5,084,989 | 2/1992 | Theurer et al. | 37/104 |
| 5,094,018 | 3/1992 | Theurer et al. | 37/104 X |
| 5,101,584 | 4/1992 | Theurer et al. | 37/104 |

FOREIGN PATENT DOCUMENTS

| | | |
|---|---|---|
| 052089 | 5/1982 | European Pat. Off. . |
| 652428 | 11/1985 | Switzerland . |
| 970010 | 9/1964 | United Kingdom . |

*Primary Examiner*—Randolph A. Reese
*Assistant Examiner*—J. Russell McBee
*Attorney, Agent, or Firm*—Collard & Roe

[57] ABSTRACT

A mobile machine arrangement for receiving, storing and distributing track ballast comprises a first machine frame, a second machine frame succeeding the first machine frame in the operating direction, a ballast storage device mounted on the first machine frame, the ballast storage device comprising a ballast conveyor band arranged at a bottom of the ballast storage device and extending longitudinally in the direction of the track, the ballast conveyor band having a forward end and the ballast storage device having an outlet below the ballast conveyor band forward end, a ballast plow arrangement vertically adjustably mounted on the first machine frame behind the ballast storage device outlet, a ballast receiving device mounted on the second machine frame and arranged to receive the track ballast, and a ballast transport device projecting from the second machine frame end towards the first machine frame, the ballast transport device having an input end preceding the ballast receiving device in the operating direction and arranged to receive the track ballast, and an output end arranged to deliver the received track ballast to the ballast conveyor band.

9 Claims, 1 Drawing Sheet

MACHINE ARRANGEMENT FOR RECEIVING, STORING AND DISTRIBUTING TRACK BALLAST

BACKGROUND OF THE INVENTION

1. Field of the Invention

The present invention relates to a mobile machine arrangement for receiving, storing and distributing track ballast, the machine arrangement being mounted on the track for mobility in an operating direction and comprising a ballast storage device comprising a ballast conveyor band arranged at a bottom of the ballast storage device and extending longitudinally in the direction of the track, the ballast conveyor band having a forward end in the operating direction, a vertically adjustable ballast plow arrangement, a ballast receiving device, such as a rotatable brush, arranged to receive the track ballast, and a ballast transport device projecting from a machine frame end towards the ballast storage device.

2. Description of the Prior Art

A machine arrangement of this type has been disclosed in European patent application No. 0 052 089, published May 19, 1982. In this machine arrangement, a rotatable ballast receiving brush is mounted on a first machine frame preceding a second machine frame in the operating direction between forwardly projecting ballast plow arrangement vertically mounted on the first machine frame and a succeeding ballast transport device. The ballast transport device comprises three parallel conveyor bands rising in a direction opposite to the operating direction and projecting from a rear end of the first machine frame. The second machine frame comprises a ballast transport car which has a conveyor band extending along the top of the car and a scraper displaceable along the top conveyor band. In operation, the front plow arrangement levels the track ballast as it distributes it over the entire width of the ballast bed. Any excess ballast is then received by the rotatable brushes from the tops of the ties and/or the cribs and is moved onto the ballast transport device which deposits it on the top conveyor band of the ballast transport car. The displaceable scraper moves the ballast from the top conveyor band into the box of the transport car. This machine arrangement cannot be used for distributing ballast to track sections which do not have enough ballast.

Swiss patent No. 652,428, published Nov. 15, 1985, discloses a ballast planing machine comprising a vertically adjustable plow arrangement mounted between two undercarriages. A rotatable ballast receiving brush is mounted at a rear end of the machine for distributing excess ballast or to direct it to a transport car for later use.

U.S. Pat. No. 5,094,018, dated Mar. 10, 1982, discloses a mobile machine for receiving and distributing track ballast, which comprises a ballast storage box having a longitudinally extending conveyor band at the bottom thereof and receiving track ballast from a rotatable ballast receiving brush and a conveyor rising therefrom and discharging the ballast onto the conveyor band in the ballast storage box. The output end of the conveyor band selectively discharges ballast from the box through outlet means. A vertically adjustable plow arrangement is mounted below the machine frame immediately behind the outlet means to distribute the discharged ballast over the width of the ballast bed. This machine arrangement is very useful for surfacing track sections exhibiting different ballast levels or densities.

U S. Pat. No. 4,576,538, dated Mar. 18, 1986, discloses a ballast storage box car with a longitudinally extending bottom conveyor band and an upwardly inclined transfer conveyor projecting from one end of the box for transferring the ballast to an adjacent box car. A modified type of freight car for bulk material with a bottom conveyor band has been disclosed in U.S. patent application Ser. No. 07/648,214, filed Jan. 31, 1991, now patent No.

SUMMARY OF THE INVENTION

It is the primary object of this invention to improve a machine arrangement of the first-described type so that larger amounts of excessive track ballast may be stored and may then be selectively distributed in track sections which require additional ballast.

The above and other objects are accomplished according to the invention with a mobile machine arrangement for receiving, storing and distributing track ballast, the machine arrangement being mounted on the track for mobility in an operating direction and comprising a first machine frame, a second machine frame succeeding the first machine frame in the operating direction and having a forward end in the operating direction, and a ballast storage device mounted on the first machine frame, the ballast storage device comprising a ballast conveyor band arranged at a bottom of the ballast storage device and extending longitudinally in the direction of the track, the ballast conveyor band having a forward end in the operating direction and the ballast storage device having outlet means below the ballast conveyor band forward end. A ballast plow arrangement is vertically adjustably mounted on the first machine frame behind the ballast storage device outlet means in the operating direction, a ballast receiving device is mounted on the second machine frame and arranged to receive the track ballast, and a ballast transport device projects from the second machine frame end towards the first machine frame, the ballast transport device having an input end preceding the ballast receiving device in the operating direction and arranged to receive the track ballast, and an output end arranged to deliver the received track ballast to the ballast conveyor band. The ballast receiving device may be a rotable brush arranged to engage the track ballast.

The ballast conveyor band is preferably upwardly inclined towards the outlet means, which makes it possible to mount a special ballast discharge device below the outlet means and also increases the storage capacity.

If drives are provided for displacing the ballast transport device perpendicularly and horizontally with respect to a transport direction of the device, the ballast may be transported without difficulties from the inclined transport device to the preceding storage device even in sharp curves.

According to a preferred embodiment, a transversely extending axle pivotally supports the ballast transport device substantially centrally between the input and output ends thereof, and a support device supports and blocks the ballast transport device on the second machine frame forward end in a selected pivoted position. This enables the ballast transport device to be pivoted during operation while being permanently supported so that proper transfer of the ballast is assured in track curves. On the other hand, the transport device may be blocked in a selected pivoted position during transit of the machine arrangement between operating sites so that the transport device is not pivoted outside the track profile.

The machine arrangement may further comprise a ballast transport car arranged between the first machine frame and the second machine frame forward end, the ballast transport car comprising a ballast conveyor band extending longitudinally in the direction of the car and an upwardly inclined ballast transfer band projecting from a forward end of the car in the operating direction and pivotal about a vertical axis. This ballast transport car preferably comprises a box having an open top and a bottom, the ballast conveyor band being arranged at the bottom of the box. This assures the transport of the stored track ballast without any difficulties while providing a very high storage capacity. This capacity may be increased according to need simply by arranging a number of transport cars between the first and second machine frames.

If the output end of the ballast transport device and an output end of the ballast transfer band are arranged substantially at the same level above the track, the machine arrangement capacity may be increased simply by mounting any desired number of transport cars between the first and second machine frames.

Alternatively and with the same result, the machine arrangement may further comprise a transport car arranged between the first machine frame and the second machine frame forward end, the ballast transport car comprising a ballast conveyor band extending longitudinally in the direction of the car from a rear end to a forward end thereof in the operating direction and projecting therefrom, the ballast conveyor band being upwardly inclined in said direction.

BRIEF DESCRIPTION OF THE DRAWING

The above and other objects, advantages and features of the invention will now be described in more detail in connection with three now preferred embodiments, taken in conjunction with the accompanying somewhat schematic drawing wherein.

DETAILED DESCRIPTION OF PREFERRED EMBODIMENTS

Figures 1, 2, 3:
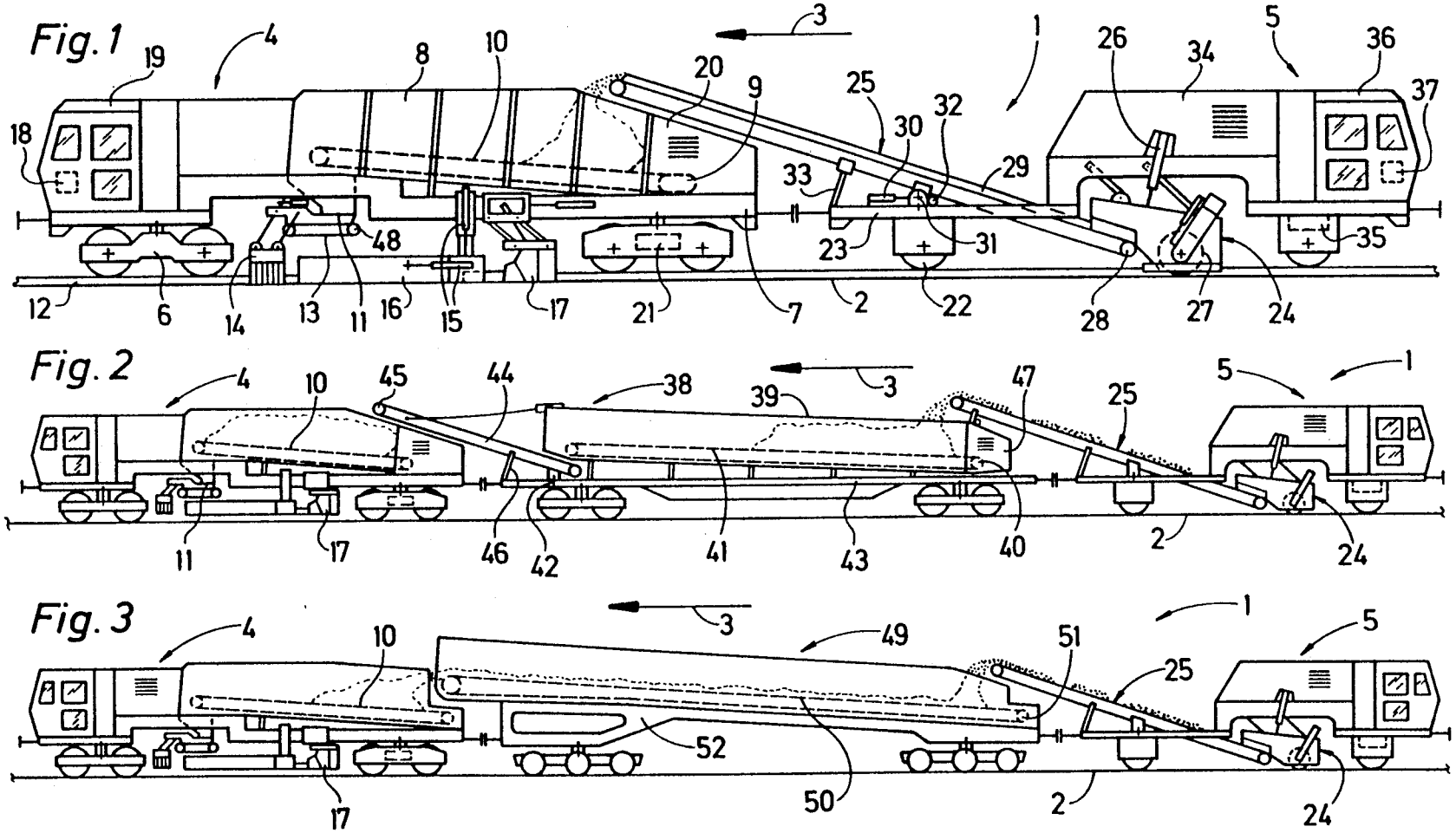
FIG. 1 shows a side elevational view of a machine arrangement comprised of first and second machine frames.
FIG. 2 is a like view of the machine arrangement of FIG. 1 and incorporating an intermediate ballast transport car.
FIG. 3 is a like view of a machine arrangement of FIG. 1 and incorporating a different type of intermediate ballast transport car.

Referring now to the drawing, wherein like reference numerals designate like parts in all figures, there is shown mobile machine arrangement 1 for receiving, storing and distributing track ballast, the machine arrangement being mounted on track 2 for mobility in an operating direction indicated by arrow 3. The machine arrangement comprises ballast plow 4 and ballast receiving car 5.

As shown in FIG. 1, the ballast plow comprises first machine frame 7 and the ballast receiving car comprises second machine frame 23 succeeding the first machine frame in the operating direction and having a forward end in the operating direction. The first machine frame is supported at its ends on track 2 by undercarriages 6 and driven in the operating direction by drive 21. Ballast storage device 8 is mounted on first machine frame 7 and comprises ballast conveyor band 10 arranged at a bottom of the ballast storage device and extending longitudinally in the direction of the track, the ballast conveyor band having a forward end in the operating direction and being driven by drive 9. The illustrated ballast storage device comprises a box which is open at the top and bottom, the bottom of the box being constituted by ballast conveyor band 10 which is upwardly inclined towards outlet means 11 arranged in the ballast storage device below the ballast conveyor band forward end.

The outlet means comprises a ballast discharge opening arranged above each track rail 12. A short ballast distributing conveyor band 13 is mounted below each ballast discharge opening and is pivotal about a vertical axis, and a vertically adjustable ballast discharge chute 14 receives the ballast from a forward end of conveyor band 13 for distributing the ballast over the two tamping areas at the intersections of the track ties and rails.

Ballast plow arrangement 16, 17 is vertically adjustably mounted on first machine frame 7 between undercarriages 6 and behind ballast storage device outlet means 11 in the operating direction. The illustrated ballast plow arrangement is comprised of shoulder plows 16 vertically and laterally adjustable by drives 15 at each side of machine frame 7 and two transversely adjacent center plows 17 which are connected to drives enabling the center plows to be vertically adjusted and longitudinally displaced. Ballast plow 4 further comprises operator's cab 19 mounted on machine frame 7 and equipped with central control 18, and central energy source 20 for the operating drives.

Ballast receiving device 24 is mounted on second machine frame 23 and is arranged to receive the track ballast. The ends of the second machine frame are also supported on track 2 by undercarriages 22 and the ballast receiving device, which is a brush 27 rotatable about a transverse axis by a drive and arranged to engage the track ballast, is vertically adjustably mounted in a recess of machine frame 23 between undercarriages 22. Ballast transport device 25 projects from the second machine frame end towards first machine frame 7 and has an input end preceding ballast receiving device 25 in the operating direction and arranged to receive the track ballast, and an output end arranged to deliver the received track ballast to ballast conveyor band 10.

The illustrated ballast transport device comprises ballast conveyor band 29 driven by drive 28 and further comprises drives 30 and 32 for respectively displacing the ballast transport device perpendicularly, i.e. pivoting it about transversely extending axle 31, and horizontally, i.e. displacing it transversely, with respect to a transport direction of the device. Axle 31 pivotally supports ballast transport device 25 substantially centrally between the input and output ends thereof, and support device 33 supports and blocks the ballast transport device on the second machine frame forward end in a selected pivoted position.

Ballast transport device 25 projects sufficiently from the forward end of second machine frame 23 to overlap bottom ballast conveyor band 10 of ballast storage device 8 when ballast receiving car 5 is coupled to ballast plow 4. The ballast receiving car is equipped with central energy source 34 for its operating drives and a drive 35 for propelling the car. Operator's cab 36 equipped with central control 37 is mounted at the rear end of second machine frame 23.

In the embodiment illustrated in FIG. 2, machine arrangement 1 further comprises ballast transport car 38 arranged between ballast plow 4 and ballast receiving car 5. Ballast transport car 38 comprises ballast conveyor band 41 extending longitudinally in the direction of the car and upwardly inclined ballast transfer band 44 projecting from a forward end of car 38 in the operating direction and pivotal about vertical axis 42. Ballast transport car 38 comprises box 39 having an open top and ballast conveyor band 41 driven by drive 40 forms the bottom of the box. Ballast plow 4, ballast transport car 38 and ballast receiving car 5 are coupled together to form a train. Ballast transfer band 44 is pivotal about vertical axis 42 and projects beyond the forward end of machine frame 43 of the ballast transport car. The ballast transfer band is driven by drive 45 and is supported by support and blocking device 46. A central energy source 47 delivers power to the operating drives of the ballast transport car. As shown in FIG. 2, the output end of ballast transport device 25 and an output end of ballast transfer band 44 are arranged substantially at the same level above the track.

FIG. 3 illustrates a machine arrangement 1 of the same type as that shown in FIG. 2 but ballast transport car 49 differs from ballast transport car 38. Ballast transport car 49 is also arranged between the first machine frame and the second machine frame forward end and comprises ballast conveyor band 50 extending longitudinally in the direction of the car from a rear end to a forward end thereof in the operating direction and driven by drive 51. However, upwardly inclined ballast conveyor band 50 projects from the forward end of machine frame 52 of the ballast transport car to overlap bottom conveyor band 10. Ballast transport car 49 may thus be used for intermediate storage of the ballast or for conveying the ballast from transport device 25 to conveyor band 10.

If the machine arrangement of the present invention is used in track sections which do not produce too much excess ballast, machine arrangement 1 illustrated in FIG. 1 may be used. Any excess ballast is continuously moved by rotating ballast receiving brush 27 onto ballast conveyor band 29 as the machine arrangement moves along track 2 in the operating direction indicated by arrow 3. The rising ballast conveyor band is driven by drive 28 to convey the ballast to the discharge end of the conveyor band whence it is thrown into ballast storage device 8 and onto bottom conveyor band 10. When the top of the ballast heap (shown in dotted lines in FIG. 1) reaches almost the upper edge of the side walls of ballast storage device 8, drive 9 is briefly actuated to convey the ballast forwardly towards outlet openings 11 and this intermittent forward movement of bottom ballast conveyor band 10 is repeated each time the ballast heap reaches the upper edge of the storage box. When the machine arrangement reaches a track section which requires additional ballast, bottom ballast conveyor 10 is rapidly moved forwardly to discharge the ballast through outlet openings 11 and to distribute it at the desired locations of track 2 by ballast distributing conveyors 13 driven by drives 48 and discharge chutes 14. When sufficient ballast has been distributed to track 2, drives 48 are stopped and conveyors 13 operate as closures over openings 11. The ballast discharged by chutes 14 is suitably distributed and planed by shoulder plows 16 and center plows 17 as machine arrangement 1 continues to advance along the track. The succeeding ballast receiving device 24 remains in operation during this ballasting operation so that any ballast on the surfaces of the ties is received by rotating brush 27 and is moved onto ballast conveyor band 29. After the ballasting operation in a track section which had too little ballast has been completed and a track section with excess ballast is reached, the above-described ballast storing operation is repeated.

When track work is done along a track where large amounts of excess ballast are expected, the machine arrangement of FIGS. 2 or 3 is used, with the interposition of any desired number of ballast transport cars 38 or 49 between ballast plow 4 and ballast receiving car 5 to provide the desired ballast storage capacity. The ballast received by ballast receiving device 24 is conveyed by ballast transport device 25 into ballast storage car 38 or 49 where it may be stored by the intermittent operation of drive 40 or 51 in the same manner as described hereinabove in connection with storage device 8 of FIG. 1. When needed, bottom conveyor band 41 or 50 is rapidly driven to transfer the ballast either by transfer band 44 or directly onto bottom conveyor band 10. In this manner, the storage capacity of machine arrangement 1 is increased and long stretches of track with differing ballast requirements may be worked, the ballast storage capacity being readily changed by the addition of any number of interposed ballast transport cars.

What is claimed is:

1. A mobile machine arrangement for receiving, storing and distributing track ballast, the machine arrangement being mounted on the track for mobility in an operating direction and comprising (a) a first machine frame, (b) a second machine frame succeeding the first machine frame in the operating direction and having a forward end in the operating direction, (c) a ballast storage device mounted on the first machine frame, the ballast storage device comprising (1) a ballast conveyor band arranged at a bottom of the ballast storage device and extending longitudinally in the direction of the track, the ballast conveyor band having a forward end in the operating direction and (2) the ballast storage device having outlet means below the ballast conveyor band forward end, (d) a ballast plow arrangement vertically adjustably mounted on the first machine frame behind the ballast storage device outlet means in the operating direction, (e) a ballast receiving device mounted on the second machine frame and arranged to receive the track ballast, and (f) a ballast transport device projecting from the second machine frame end towards the first machine frame, the ballast transport device having (1) an input end preceding the ballast receiving device in the operating direction and arranged to receive the track ballast, and (2) an output end arranged to deliver the received track ballast to the ballast conveyor band.

2. The machine arrangement of claim 1, wherein the ballast receiving device is a rotable brush arranged to engage the track ballast.

3. The machine arrangement of claim 1, wherein the ballast conveyor band is upwardly inclined towards the outlet means.

4. The machine arrangement of claim 1, further comprising a drive means for displacing the ballast transport device perpendicularly and horizontally with respect to a transport direction of the device.

5. The machine arrangement of claim 1, further comprising a transversely extending axle pivotally supporting the ballast transport device substantially centrally between the input and output ends thereof, and a support device supporting and blocking the ballast transport device on the second machine frame forward end in a selected pivoted position.

6. The machine arrangement of claim 1, further comprising a ballast transport car arranged between the first machine frame and the second machine frame forward end, the ballast transport car comprising a ballast conveyor band extending longitudinally in the direction of the car and an upwardly inclined ballast transfer band projecting from a forward end of the car in the operating direction and pivotal about a vertical axis.

7. The machine arrangement of claim 6, wherein the ballast transport car comprises a box having an open top and a bottom, the ballast conveyor band being arranged at the bottom of the box.

8. The machine arrangement of claim 6, wherein the output end of the ballast transport device and an output end of the ballast transfer band are arranged substantially at the same level above the track.

9. The machine arrangement of claim 1, further comprising a ballast transport car arranged between the first machine frame and the second machine frame forward end, the ballast transport car comprising a ballast conveyor band extending longitudinally in the direction of the car from a rear end to a forward end thereof in the operating direction and projecting therefrom, the ballast conveyor band being upwardly inclined in said direction.

* * * * *